US012245640B2

(12) United States Patent
Weber et al.

(10) Patent No.: US 12,245,640 B2
(45) Date of Patent: Mar. 11, 2025

(54) SMOKE-FREE CIGARETTE

(71) Applicant: OLIG AG, Lucerne (CH)

(72) Inventors: Stefan Weber, Karlsruhe (DE); Petra Werner, Schirgiswalde-Kirschau (DE)

(73) Assignee: OLIG AG, Lucerne (CH)

( * ) Notice: Subject to any disclaimer, the term of this patent is extended or adjusted under 35 U.S.C. 154(b) by 354 days.

(21) Appl. No.: 17/765,551

(22) PCT Filed: Oct. 1, 2020

(86) PCT No.: PCT/EP2020/077559
§ 371 (c)(1),
(2) Date: Mar. 31, 2022

(87) PCT Pub. No.: WO2021/064119
PCT Pub. Date: Apr. 8, 2021

(65) Prior Publication Data

US 2022/0248771 A1 Aug. 11, 2022

(30) Foreign Application Priority Data

Oct. 1, 2019 (DE) ..... 10 2019 126 490.1

(51) Int. Cl.
*A24F 42/10* (2020.01)
*A24F 42/60* (2020.01)

(52) U.S. Cl.
CPC ..... *A24F 42/10* (2020.01); *A24F 42/60* (2020.01)

(58) Field of Classification Search
CPC ..... A24F 42/10; A24F 42/60
See application file for complete search history.

(56) References Cited

U.S. PATENT DOCUMENTS

| | | | | |
|---|---|---|---|---|
| 5,285,798 | A | 2/1994 | Banerjee et al. | |
| 2006/0191546 | A1 | 8/2006 | Takano et al. | |
| 2015/0223520 | A1* | 8/2015 | Phillips | A61M 11/047 131/328 |
| 2017/0196262 | A1 | 7/2017 | Brereton et al. | |
| 2017/0340008 | A1* | 11/2017 | Sebastian | A24D 1/025 |
| 2018/0092399 | A1* | 4/2018 | Kieslich | A61M 15/06 |

FOREIGN PATENT DOCUMENTS

| | | | |
|---|---|---|---|
| CN | 203618776 | U | 6/2014 |
| DE | 298877 | A5 | 3/1992 |
| EP | 2138058 | A1 | 12/2009 |
| EP | 2292109 | A1 | 3/2011 |
| EP | 2897478 | B1 | 7/2015 |
| WO | 2015175979 | A1 | 11/2015 |
| WO | 2016071027 | A1 | 5/2016 |

* cited by examiner

*Primary Examiner* — Christopher M Rodd
*Assistant Examiner* — Jennifer A Kessie
(74) *Attorney, Agent, or Firm* — Dilworth & Barrese, LLP.; Michael J. Musella, Esq.

(57) ABSTRACT

The present invention relates to a smoke-free cigarette comprising a heat source disposed in a container, a reservoir containing nicotine and/or one or mote flavouring agents, and a trigger mechanism for the heat source. According to the claimed invention, the cigarette has an outer shell defining a space in which the heat source and the reservoir are disposed, the outer shell and/or the wall of the container being made of aluminium and/or stainless steel or comprising one or more of these materials.

14 Claims, 1 Drawing Sheet

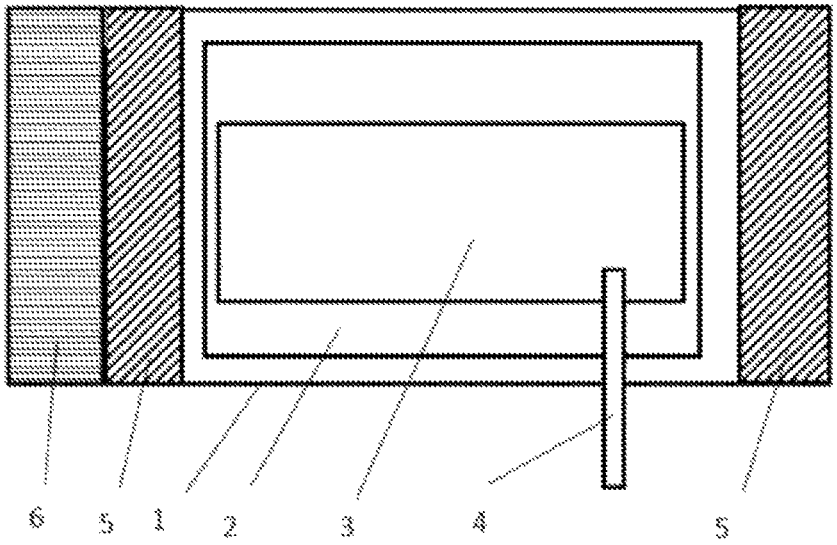
6
5
1
2
3
4
5

SMOKE-FREE CIGARETTE

BACKGROUND OF THE INVENTION

The present invention relates to a smoke-free cigarette comprising a heat source arranged in a container, a reservoir containing nicotine, and/or one or more flavoring agents, and a trigger mechanism for the heat source, wherein the cigarette has an outer sheath that bounds a space in which the heat source and the reservoir are arranged.

Smoke-free cigarettes are known from the prior art in which the atomization of liquids takes place to release the flavorings or the tobacco.

Smoke-free cigarettes in which electric vaporizers or electric heating elements are used to open up compressed tobacco solids and systems having an autonomous heat core on a sodium acetate base in which the heat development takes place by crystallization are also known from DE 10 2008 030 549 A1, for example,.

There is a problem with known smoke-free cigarettes that the materials used for the heat core and for the desorption-tight outer sheath that typically consist of plastic are prohibited, for example in Germany and also in the European Union as a whole or are at least subject to strict regulations. The prohibitions are increasing greatly worldwide.

SUMMARY OF THE INVENTION

Against this background, it is the underlying object of the present invention to provide a smoke-free cigarette that does not have these disadvantages.

This object is achieved by a smoke-free cigarette having the features herein.

Provision is accordingly made that the outer sheath and/or the wall of the container consists/consist of aluminum and/or stainless steel or comprises/comprise a plurality of these materials.

The aluminum or stainless steel wall is preferably thin-walled.

These materials are harmless for the user. There is a further advantage in that a recycling-friendly and environment-relieving design is thus possible. At the same time, the heat transfer from the heat source to the nicotine and flavor matrix or to the reservoir that contains nicotine and flavors is improved.

If the outer sheath of the cigarette is preferably produced from thin-walled aluminum or stainless steel, this design enables a "haptic experience" to be communicated to the user in that the period of use of the cigarette is signaled via the heat dissipation to the outer sheath.

A nicotine flavoring matrix can be located in the reservoir.

The container, i.e. the heat source, contains the heat carrier.

The smoke-free cigarette is preferably autonomous, i.e. it does not require any external energy supply, for instance for the purpose of heat development.

The heat source can comprise or consist of a material that is capable of crystallization and the trigger mechanism is configured to effect the crystallization. It initiates the recrystallization of the PCM (phase change material) while releasing the crystallization heat. Injection processes, electrical pulse processes and mechanical perforation processes are suitable for the triggering, for example.

The reservoir, i.e. the nicotine and/or the flavoring agent or agents is/are preferably likewise received in a container that has one or more openings so that a supply with the draw of air of the user is possible and its wall consists of aluminum and/or stainless steel or comprises one or more of these materials. A preferably thin-walled container is thus preferably also provided for the reservoir. This container must have one or more openings so that the nicotine and/or the flavoring or flavorings reach the user. The container having the heat source can in contrast be closed at all sides.

The separation of the flavor and nicotine matrix can likewise take place in this manner. Improvements in the effect with respect to the flavor composition and to the time sequence of the individual components result in this manner.

It is advantageous if the container containing the heat source is arranged within the reservoir.

The wall of the container can be designed with air conducting means, in particular with grooves and/or fins, on its outer side to improve the drawing behavior and the heat transfers of the cigarette on its use.

The heat carrier source preferably comprises or consists of a phase change material that is present as undercooled melt.

The phase change material such as sodium acetate can be configured to generate a temperature in the phase change material during crystallization in the range from 60° C. to 90° C. This temperature is sufficient to effect a desorption of the substances in the reservoir or in the nicotine/flavor matrix that is to be supplied to the user with the draw of air.

Temperature sensitive color materials that have a color dependent on the temperature can be applied to the outer sheath. Temperature sensitive color materials can thus be applied to the outer sheath that are then able to visually signal the use phase by color changes on a change of temperature. It is simultaneously possible to permanently mark consumed systems. This method can be used to effectively support recycling.

The outer sheath of the cigarette preferably has to open ends, with one end representing the air inlet opening and the other end having the outlet opening through which the air charged with nicotine and/or flavorings and heated is supplied to the user. The mouthpiece of the cigarette can be located directly or indirectly adjacent to the outlet opening.

A tobacco reservoir can be located in one or both open ends of the outer sheath.

The cigarette preferably has a mouthpiece. The mouthpiece can be surrounded by the outer sheath. The case is also covered by the invention that the mouthpiece is not surrounded by the outer sheath and is e.g. directly adjacent thereto.

Provision is made in an embodiment that the reservoir and the heat source are present as modular components that can be nondestructively released from one another. Individual components of the smoke-free cigarette can thus be designed as reusable units that can be used individually or together by the user. It is possible in this manner to offer user-related compositions.

In summary, the invention therefore relates in an embodiment to an autonomous system of a smoke-free cigarette that consists of an autonomous heat unit, a trigger mechanism, and a matrix for storing nicotine and flavoring agents. Conventional tobacco that is lightly enriched with nicotine is stuffed in the cylindrical inner space. The mouthpiece provides a constant draw of air within the system. The heat dissipation process is initiated via the trigger mechanism. The heat unit provides approximately 58° C. after the triggering. This heat is transferred to the nicotine-flavoring matrix and enables the release of nicotine and flavoring agents. A metered amount of nicotine and flavoring agents reaches the user of the smokeless cigarette via the air flow metered through the filter piece.

It is pointed out at this point that the terms "a" and "one" do not necessarily refer to exactly one of the elements, even though this represents a possible embodiment, but can also designate a plurality of elements. The use of the plural equally also includes the presence of the element in question in the singular and, conversely, the singular also includes a plurality of the elements in question.

BRIEF DESCRIPTION OF THE DRAWING

Further details and advantages of the invention will be explained in more detail with reference to an embodiment shown in the drawing.

The only FIGURE shows the basic design of the smoke-free cigarette in accordance with the invention.

DESCRIPTION OF THE PREFERRED EMBODIMENT

Reference numeral 1 is the outer sheath that represents the outer wall of the cigarette. The outer sheath forms the outer side of the cigarette. It can be provided with temperature sensitive colors that indicate the temperature present in the interior of the cigarette.

The outer sheath is preferably designed as a hollow cylinder open at one or both sides and surrounds a space in which a container 2 is located in which the nicotine and flavor matrix is received.

The container 3 contains the PCM in the form of an undercooled melt. The phase change material can be sodium acetate or another material that carries out a phase change, preferably solid-liquid, in the temperature range in question here.

As can be seen from the FIGURE, the heat source or the container 3 is located within the nicotine and/or flavoring matrix or within the container 2 receiving it.

The walls of the containers 2, 3 and the outer sheath 1 consist of thin-walled aluminum or stainless steel.

The outer sheath 1 is closed by a plug of tobacco 5 at both sides at its ends. The containers 2, 3 are located in the region between the plugs of tobacco 5.

If the trigger mechanism 4 that in the embodiment shown here projects outwardly over the outer sheath is actuated by the user, the crystallization procedure is triggered, whereby heat is produced. The heat carrier thus preferably consists of a suitable PCM. It should have a crystallization heat of 50 to 90° C., be non-toxic, and be licensed or cable of licensing in accordance with the respectively applicable food guidelines. The PCM must be in the so-called undercooled melt.

The mouthpiece 6 of the smoke-free cigarette adjoins the plug of tobacco facing the user.

The invention claimed is:

1. A smoke-free cigarette comprising a heat source arranged in a first container (3), a reservoir containing nicotine and/or one or more flavoring agents, and a trigger mechanism (4) for the heat source, wherein the cigarette has an outer sheath (1) that bounds a space in which the heat source and the reservoir are arranged, the outer sheath (1) and/or a wall of the first container (3) comprises a material selected from the group consisting of aluminum, stainless steel, and mixtures thereof, a second container (2) in which the reservoir is received, has one or more openings and a wall comprising a material selected from the group consisting of aluminum, stainless steel, and mixtures thereof, the first container (3) containing the heat source is arranged within the reservoir; and said second container (2) concentrically surrounds said first container (3).

2. A cigarette in accordance with claim 1, wherein the heat source comprises a material capable of crystallization; and the trigger mechanism is configured to effect the crystallization.

3. A cigarette in accordance with claim 1, wherein the wall of the first container is designed with air conducting means, in particular with grooves and/or fins, on its outer side to improve the drawing behavior.

4. A cigarette in accordance with claim 1, wherein the heat carrier source comprises a phase change material present as an undercooled melt.

5. A cigarette in accordance with claim 4, wherein the phase change material is configured to generate a temperature in the phase change material during crystallization in the range from 60° C. to 90° C.

6. A cigarette in accordance with claim 1, wherein temperature sensitive color materials that have a color depending on the temperature are applied to the outer sheath.

7. A cigarette in accordance with claim 1, wherein the outer sheath has two open ends.

8. A cigarette in accordance with claim 7, wherein a tobacco reservoir is located in one or both open ends.

9. A cigarette in accordance with claim 1, wherein the cigarette has a mouthpiece.

10. A cigarette in accordance with claim 1, wherein the reservoir and the heat source are present as modular components that can be nondestructively released from one another.

11. A cigarette in accordance with claim 1, wherein the outer sheath (1) is closed by a plug (5) of tobacco at each end thereof, and with said first and second containers (2, 3) located between the plugs (5) of tobacco.

12. A cigarette in accordance with claim 11, wherein a mouthpiece (6) adjoins one of said plugs (5) of tobacco.

13. A cigarette in accordance with claim 1, wherein said trigger mechanism (4) projects outwardly over the outer sheath (1).

14. A cigarette in accordance with claim 13, wherein said trigger mechanism (4) penetrates both said first and second containers (2,3).

* * * * *